US008641481B2

(12) United States Patent
Francois et al.

(10) Patent No.: US 8,641,481 B2
(45) Date of Patent: Feb. 4, 2014

(54) REINFORCED BONDED ABRASIVE TOOLS

(75) Inventors: Emmanuel C. Francois, Sterling, MA (US); Guohua Zhang, Northborough, MA (US); Michael W. Klett, Holden, MA (US)

(73) Assignees: Saint-Gobain Abrasives, Inc., Worcester, MA (US); Saint-Gobain Abrasifs, Conflans-Sainte-Honorine (FR)

( * ) Notice: Subject to any disclaimer, the term of this patent is extended or adjusted under 35 U.S.C. 154(b) by 333 days.

(21) Appl. No.: 12/645,817

(22) Filed: Dec. 23, 2009

(65) Prior Publication Data

US 2010/0190424 A1 Jul. 29, 2010

Related U.S. Application Data

(60) Provisional application No. 61/141,429, filed on Dec. 30, 2008.

(51) Int. Cl.

| | |
|---|---|
| ***B24D 5/08*** | (2006.01) |
| ***B24D 5/12*** | (2006.01) |
| ***B24D 18/00*** | (2006.01) |

(52) U.S. Cl.
USPC ..... 451/541

(58) Field of Classification Search
USPC ..... 451/541, 548, 540; 51/293, 307, 308
See application file for complete search history.

(56) References Cited

U.S. PATENT DOCUMENTS

| | | | |
|---|---|---|---|
| 3,619,151 | A | 11/1971 | Sheets, Jr. et al. |
| 3,838,543 | A | 10/1974 | Lakhani |
| 3,868,793 | A | 3/1975 | Corcoran et al. |
| 4,164,098 | A | 8/1979 | Akita |
| 4,194,098 | A | 3/1980 | Carlson |
| 4,918,116 | A | 4/1990 | Gardziella et al. |
| 5,203,886 | A | 4/1993 | Sheldon et al. |
| 5,221,294 | A | 6/1993 | Carman et al. |
| 5,429,648 | A | 7/1995 | Wu |
| 5,738,696 | A | 4/1998 | Wu |
| 5,738,697 | A | 4/1998 | Wu et al. |
| 6,609,964 | B1 | 8/2003 | Avril et al. |
| 6,685,755 | B2 | 2/2004 | Ramanath et al. |
| 6,755,729 | B2 | 6/2004 | Ramanath et al. |

FOREIGN PATENT DOCUMENTS

| | | | |
|---|---|---|---|
| AR | 012763 | A1 | 11/2000 |
| AR | 046894 | A1 | 12/2005 |
| CN | 1186725 | A | 7/1998 |
| EP | 1204509 | B1 | 6/2004 |
| TW | 200306902 | | 12/2003 |
| TW | 200812756 | | 3/2008 |
| WO | 2007101957 | A2 | 9/2007 |

OTHER PUBLICATIONS

International Preliminary Report on Patentability mailed Jul. 14, 2011, from counterpart International Application No. PCT/US2009/069399, filed on Dec. 23, 2009.

International Search Report and Written Opinion of the International Searching Authority mailed Aug. 17, 2010, from counterpart International Application PCT/US2009/069399, filed Dec. 23, 2009.

*Primary Examiner* — Robert Rose

(74) *Attorney, Agent, or Firm* — Abel Law Group, LLP; Joseph P. Sullivan

(57) ABSTRACT

Bonded abrasive tools, e.g., grinding wheels, can be reinforced using, for instance, one or more fiberglass web(s) having a surface of glass per unit of at least 0.2. Alternatively or in addition, the fiberglass web has a thickness of 2 mm or less. The web can be designed to provide improved adhesion between the fiberglass reinforcement and the mixture employed to form the bonded abrasive tool. In some examples, the middle reinforcement at the neutral zone of the wheel can be eliminated or minimized.

31 Claims, 7 Drawing Sheets

REINFORCED BONDED ABRASIVE TOOLS

RELATED APPLICATIONS

This application claims the benefit under 35 USC 119(e) of U.S. Application No. 61/141,429, filed on Dec. 30, 2008, which is incorporated herein by reference in its entirety.

BACKGROUND OF THE INVENTION

Bonded cut-off wheels can be used to snag or slice materials such as stone or metal. To improve the quality of the cut, reduce power consumption and weight, cut-off wheels often have relatively thin diameters. Thin wheels, however, tend to be less resistant to forces acting on the wheel during its operation. As a result, such wheels often are internally reinforced.

In many cases thin wheels include discs cut from nylon, carbon, glass or cotton cloth and the cost of the reinforcement material can add to the overall manufacturing cost. In addition, incorporating multiple discs can complicate the fabrication process and the presence and/or integration of the reinforcement material within the wheel can affect wheel properties and/or performance.

A need continues to exist, therefore, for cut-off wheels that exhibit good mechanical properties and that can be produced economically, without sacrificing wheel performance and usable life of the wheel. In a more general sense, there is a need for improved reinforced bonded abrasive wheels.

SUMMARY OF THE INVENTION

Reinforcing features and techniques described herein can be used in any bonded abrasive tool, utilizing any suitable abrasive grains and bond system. These features and techniques can be used individually or in combination, and generally include optimally configuring characteristics of a reinforcement such as a reinforcing fiber mesh (including size of openings in the mesh), improving adhesion between reinforcement layer and bond system, and minimizing the quantity of reinforcing material needed, e.g., by strategic placement and/or dimensioning of reinforcement layers.

Some aspects of the invention relate to reducing or minimizing the amount of reinforcement material employed in a bonded abrasive tool, e.g., a grinding wheel. In some implementations, the material is fiberglass. Other aspects of the invention relate to improving the adhesion between a fiberglass reinforcement and the composition making up the body of the wheel, e.g., a composition containing abrasive grains held in a resin bond.

In one embodiment, for example, the invention is directed to a bonded abrasive wheel including a first face, a second face, and a grinding zone between the first face and the second face, the grinding zone extending from an unused zone to a wheel outer diameter; a first reinforcement near the first face; a second reinforcement near the second face; and an optional middle reinforcement at a neutral zone of the wheel, wherein the optional middle reinforcement has an outer diameter that is smaller than the wheel outer diameter.

In another embodiment, the invention is directed to a bonded abrasive tool that includes at least one fiberglass web that has a fiberglass surface per unit that is no greater than 0.95, e.g., within the range of from about 0.2 to about 0.95.

In yet another embodiment, the invention is directed to a bonded abrasive tool that includes a fiberglass web having a thickness that is no greater than about 2 mm.

In a further embodiment, the invention is directed to a bonded abrasive tool that includes one or more fiberglass webs, wherein the one or more fiberglass web(s) do not include wax additives. In still other embodiments, the invention is directed to a bonded abrasive tool made using a fiberglass web that has a second coating that excludes wax or that is partially crosslinked.

In another embodiment, the invention is directed to a method for producing a bonded abrasive article, the method comprising: combining abrasive grains and a bonding material to prepare a mixture; molding the mixture into a green body that includes at least one fiberglass reinforcement; and curing the bonding material to produce the bonded abrasive article, wherein: (i) the fiberglass reinforcement is coated with a resin that does not include wax additives; or (ii) the fiberglass reinforcement has a fiberglass surface density that is no greater than 0.95.

In yet another embodiment, the invention is directed to a method for improving the performance of a fiber-reinforced cut-off wheel, said performance being measured by a wheel G-ratio, the method comprising reducing an amount of fiber reinforcement employed in a grinding zone of the wheel.

Embodiments of the present invention have many advantages. For example, bonded cut-off wheels such as described herein have good mechanical properties and perform well, as indicated, for instance, by their grinding performance or G ratio. Some implementations of the invention reduce fiberglass requirements, resulting in lower manufacturing costs. Reductions in fiberglass material can provide additional abrasive grain in the grinding zone, thereby improving the wheel performance. In other embodiments, wheel performance is enhanced by an improved adhesion or coupling between the fiber reinforcement and the mixture employed to fabricate the bonded abrasive wheel.

BRIEF DESCRIPTION OF THE DRAWINGS

In the accompanying drawings, reference characters refer to the same parts throughout the different views. The drawings are not necessarily to scale; emphasis has instead been placed upon illustrating the principles of the invention. Of the drawings.

DETAILED DESCRIPTION OF THE PREFERRED EMBODIMENTS

The invention generally relates to bonded abrasive tools and in particular to reinforced bonded abrasive tools.

Bonded abrasive tools generally are characterized by a three dimensional structure, in which abrasive grains are held in a matrix or bond. These tools have numerous applications and often are provided with one or more reinforcement layers. In many aspects of the invention at least one reinforcement layer employed is made of fiber, preferably glass fiber.

As used herein, terms such as "reinforced" or "reinforcement" refer to discrete layers or inserts or other such components of a reinforcing material that is different from the bond and abrasive materials employed to make the bonded abrasive tool. Terms such as "internal reinforcement" or "internally reinforced" indicate that these components are within or embedded in the body of the tool.

In some implementations the tools are large diameter cut-off wheels (LDCO), typically having a diameter of at least 800 millimeter (mm). Specific examples of cut-off wheels according to embodiments of the invention have a thickness that is no greater than about 16 mm, e.g., within the range of from about 9 mm to about 16 mm and a diameter within of at least 800 mm, e.g., within the range of from about 800 mm to about 1600 mm. Diameter to thickness ratios can be in the range of 200:3 to 100:1.

Figure 1A:
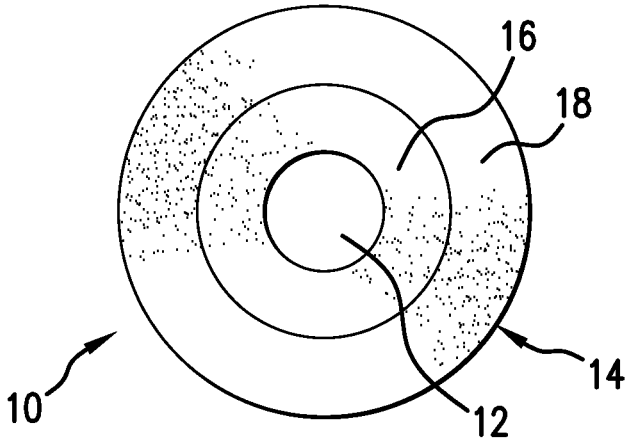
FIGS. 1A and 1B are, respectively, a top view and a cross-sectional view of a cut perpendicular to the diameter of a bonded abrasive wheel configured in accordance with an embodiment of the present invention.
Figure 1B:
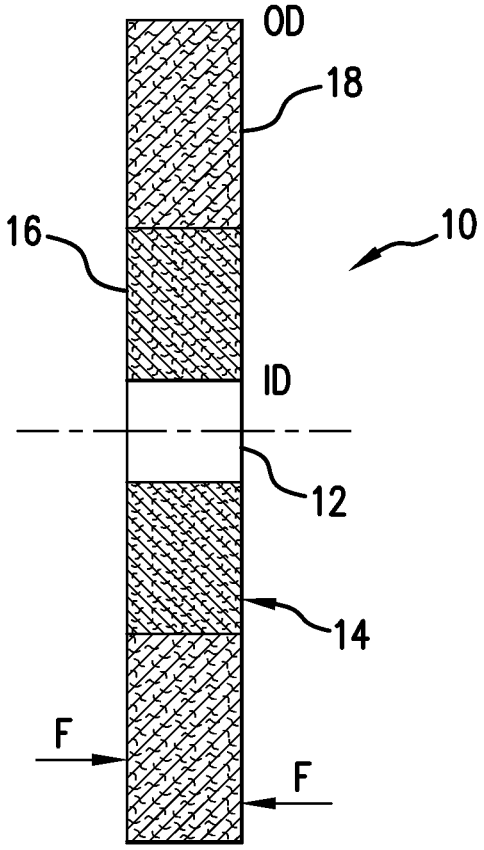

Shown in FIGS. 1A and 1B is cut-off wheel 10 which can be reinforced as described herein. Wheel 10 has arbor hole 12, for mounting the wheel on a rotating spindle of a machine, and wheel body 14 which extends from the wheel inner diameter or ID, defined by arbor hole 12, to the wheel outer diameter or OD.

Wheel body 14 includes unused region or unused zone 16, typically secured between flanges (not shown in FIGS. 1A and 1B) and thus unavailable for cutting a workpiece when the wheel is operated, and grinding region or grinding zone 18.

While stresses in the unused zone 16 are mostly caused by centrifugal forces, breakage in the grinding zone, typically occurring at the outer periphery of this zone, often is caused by interaction between the wheel 10 and the workpiece, as indicated by arrows F. For instance, during a cutting process, a workpiece can shift, twisting wheel 10.

In cut-off wheels the internal reinforcement can be, for example, in the shape of a disc with a middle opening to accommodate the arbor hole of the wheel. In some wheels, the reinforcements extend from the arbor hole to the periphery of the wheels. In others, reinforcements extend from the periphery of the wheel to a point just under the flanges used to secure the wheel. Some wheels may be "zone reinforced" with (internal) fiber reinforcement around the arbor hole and flange areas of the wheel (about 50% of the wheel diameter).

Figure 2A:
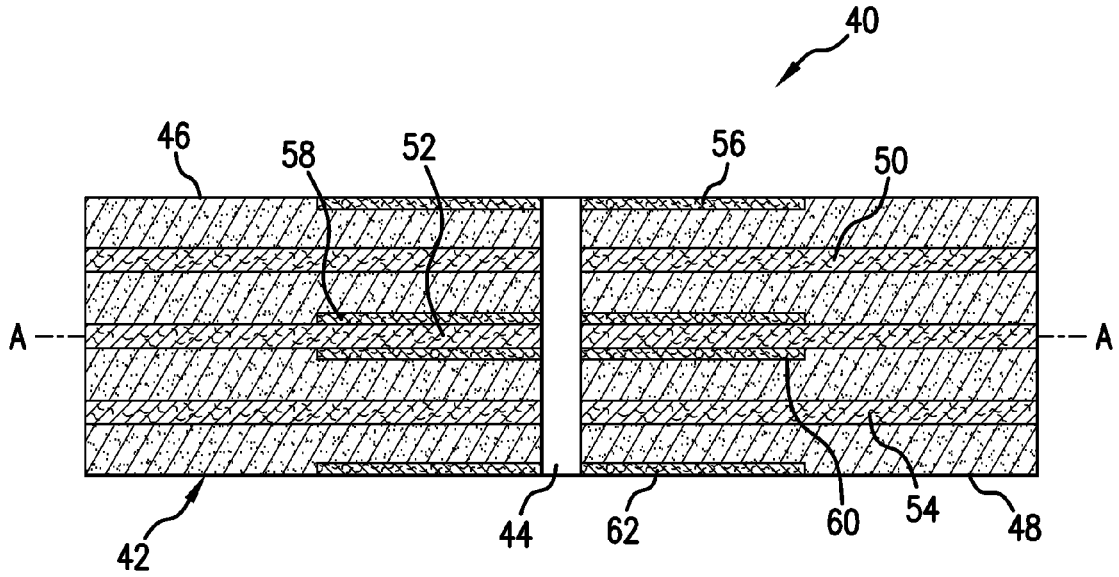
FIG. 2A is a cross-sectional view of a cut-off wheel that can be reinforced according to embodiments of the invention.

Shown in FIG. 2A, for example, is cut off wheel 40 including wheel body 42 defining arbor hole 44 and having faces 46 and 48. Wheel 40 includes three full diameter reinforcement layers, made, for instance, of glass fiber, namely layers 50, 52 and 54, with layer 52 being disposed at the central symmetric plane of the wheel, indicated in FIG. 2 as neutral axis A. Wheel 40 also can include half diameter fiberglass reinforcement layers 56, 58, 60 and 62. Full diameter reinforcements and half diameter reinforcements can be made from the same or different types of material, e.g., different types of fiberglass material.

Figure 2B:
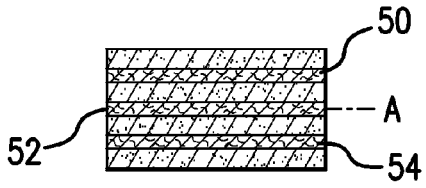
FIG. 2B is a cross-sectional view of the grinding zone region of a wheel such as that shown in FIG. 2A.

Shown in FIG. 2B is a region of the grinding zone of cut-off wheel 40, including sections of full diameter reinforcement layers 50, 52 and 54.

Bonded abrasive wheels and other bonded abrasive tools can be reinforced using any one or any combination of the features and/or techniques described herein, such as, for instance, minimizing the quantity of reinforcing material utilized, e.g., by strategic placement and/or sizing (dimensioning) of reinforcement layers and/or using a fiber reinforcement web having openings optimally sized for the abrasive application, and/or configuring the reinforcement layer to improve its adhesion to the bond system. Details associated with each of these techniques will be discussed in turn. Background details related to reinforcement techniques and materials are described, for example, in U.S. Pat. No. 3,838,543, issued on Oct. 1, 1974 to Lakhani et al., which is incorporated herein by reference in its entirety.

Some embodiments of the invention are directed to reducing the amount of reinforcement material employed to reinforce bonded abrasive tools and relate to the dimensional aspects of the reinforcement as well as the strategic placement of reinforcement layers within the composite. These embodiments can be practiced with any type of suitable bond, abrasive grains, optional additives and reinforcement materials that can be utilized to fabricate abrasive articles. In some implementations, these aspects of the invention are practiced in conjunction with fiberglass reinforcement webs having one or more properties further described below.

In one embodiment of the present invention, a bonded cut-off wheel is reinforced by eliminating the middle reinforcement layer from the grinding zone. Contrary to conventional thinking, eliminating the reinforcement layer at the neutral axis A (shown in FIGS. 2A and 2B) from the grinding zone does not negatively impact mechanical properties, e.g., the bending strength, of the wheel and illustrative wheels of the invention can have a bending strength of 75 Mega Pascals (MPa) or more.

Figure 3:
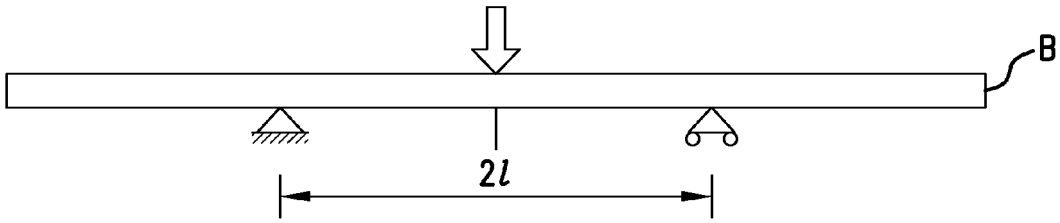
FIG. 3 is a schematic representation of bending conditions applied on a cut-off wheel.
Figure 4:
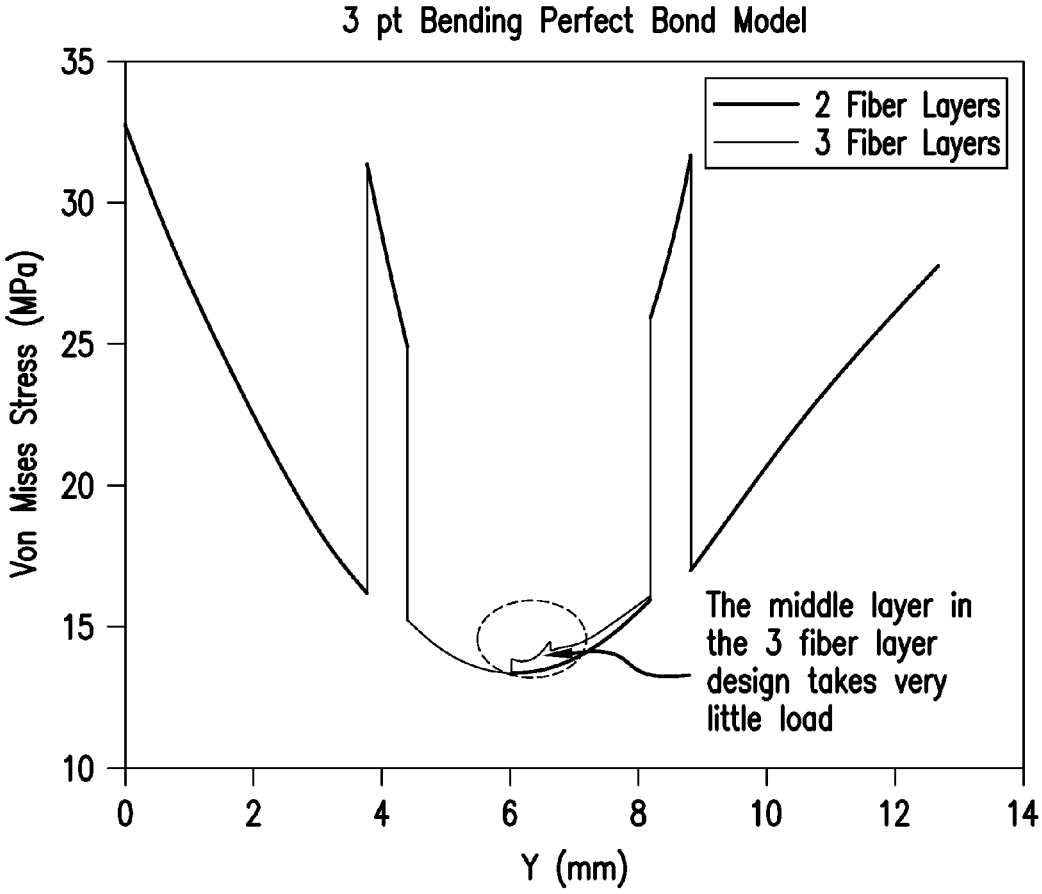
FIG. 4 is a comparison between a wheel model including three reinforcements (continuous line) and a model including two reinforcements (open circles).

A three point bending test is illustrated schematically as bending loading conditions B shown as the wheel cross section in FIG. 3 and indicates that there is minimal stress on the middle reinforcement layer. The stress distribution for the two cases is shown in FIG. 4, where a conventional wheel model including three reinforcements (continuous line) is compared with a model including two reinforcements (open circles), in accordance with an embodiment of the present invention. As seen in FIG. 4, the middle reinforcement takes very little load and can be eliminated, thereby reducing the amount of reinforcement material and associated costs.

Figure 5:
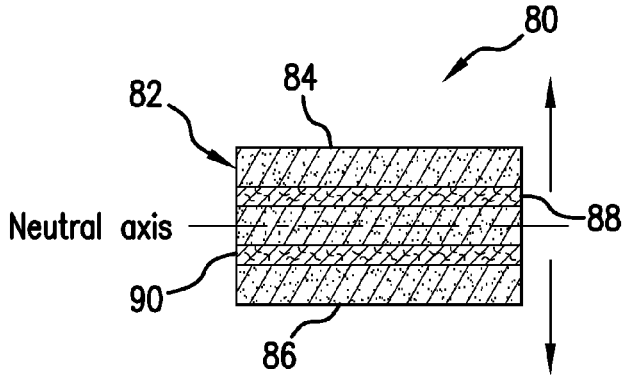
FIG. 5 is a cross-sectional view of the grinding zone of a bonded abrasive wheel configured in accordance with an embodiment of the present invention.

As an example, shown in FIG. 5 is wheel section 80, having wheel body 82 and faces 84 and 86. Reinforcements 88 and 90, made for example of fiberglass material, are embedded in wheel body 82 and no middles reinforcement layer is employed. Thus in specific embodiments, the entire reinforcement provided in the grinding zone consists or consists essentially of the two layers described above, e.g., layers 88 and 90. Preferably, neither layer is positioned at the neutral zone or axis.

A parameter that correlates to the bending strength of a cut-off wheel is the space or distance between reinforcements 88 and 90. In specific implementations a cut-off wheel which is not reinforced at the neutral axis within the grinding zone, has a thickness within the range of from about 12 mm to about 16 mm, and a distance between reinforcements 88 and 90 that is within the range of from about 2 mm to about 10 mm. In preferred embodiments, one and preferably both reinforcements 88 and 90 are as far away as possible from the neutral axis, or as close as possible to faces 82 and 84. In FIG. 5, this is illustrated schematically by the arrows pointing away from each other. In some implementations, one or both reinforcements are at the face of the wheel.

Figure 6:
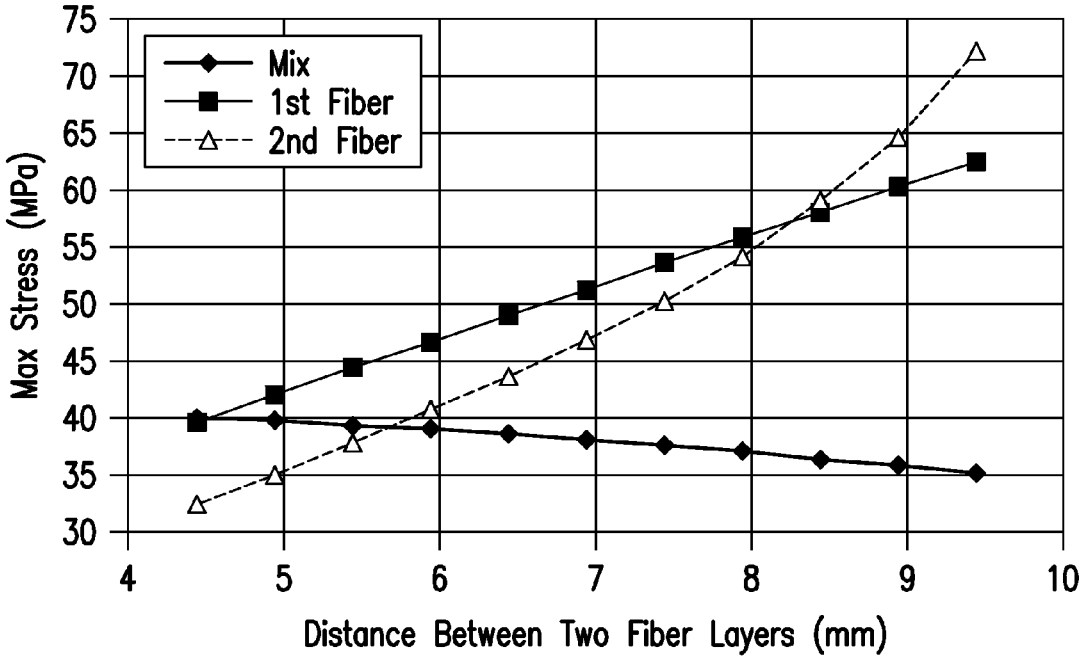
FIG. 6 is a series of plots illustrating the stress exerted on the mix and the two reinforcement layers shown in FIG. 5 as a function of the distance between the layers.

Shown in FIG. 6 are plots obtained by modeling calculations regarding the maximum stress exerted on the mix layer (containing abrasive grains and bond), first reinforcement layer and second reinforcement layer as a function of the distance between the two reinforcement layers. As seen in FIG. 6, the maximum stress exerted on the mix layer decreases as the distance between the reinforcement layers increases.

Without wishing to be held to a particular interpretation, it is believed that reinforcement layers that are close to the wheel faces are more capable to accommodate bending loads, thus reducing the stress level in the body of the wheel, e.g., the mixture containing abrasive grains and bond.

The requirements for reinforcement material also can be reduced by retaining the middle layer while decreasing its overall size. Preferably, such a middle reinforcement has an outer diameter that is smaller than the outer diameter of the wheel. In one case, the middle layer can extend from the inner diameter at the arbor hole, through the unused zone and partially through the grinding zone. For instance, the middle layer can extend to a distance that is about 80% of the outer diameter of the wheel. In other instances, the middle reinforcement layer can extend to less than about 80% of the outer diameter of the wheel, e.g., 70%, 60%, 50%, 40%, or lower.

In a specific example, a wheel having a 53 inch diameter has a reinforcement layer in the neutral zone that is 42 inch diameter. While providing reinforcement in the region of the arbor this particular example allows for more abrasive material to be present in the grinding zone, thereby improving the grinding performance or G-ratio by at least 16% and reducing costs associated with the amount of reinforcement material, e.g., fiberglass, utilized.

As described above, preferred embodiments include those in which the remaining full size reinforcement layers are as far from one another, or as close to the wheel faces as possible.

In many embodiments, one or more of the reinforcement layers employed are made of fiberglass and the invention also relates to properties, design or integration of fiberglass reinforcements in a bonded abrasive article such as a cut-off wheel. In specific examples, the fiberglass is in the form of a web, e.g., a material woven from very fine fibers of glass, also referred to herein as glass cloth. One, two or more than two such fiberglass webs can be used.

In specific implementations, the fiberglass utilized is E-glass (alumino-borosilicate glass with less than 1 wt % alkali oxides. Other types of fiberglass, e.g., A-glass (alkali-lime glass with little or no boron oxide), E-CR-glass (alumino-lime silicate with less than 1 wt % alkali oxides, with high acid resistance), C-glass (alkali-lime glass with high boron oxide content, used for example for glass staple fibers), D-glass (borosilicate glass with high dielectric constant), R-glass (alumino silicate glass without MgO and CaO with high mechanical requirements), and S-glass (alumino silicate glass without CaO but with high MgO content with high tensile strength).

The fiberglass webs described below can be arranged in the bonded abrasive tool in any suitable manner in. Specific examples include conventional configurations as well as reinforcement geometries such as those discussed above. For instance, a cut-off wheel can include two full diameter fiberglass webs positioned near the faces of the wheel and a middle web, at the neutral axis, the middle web having an outer diameter that is smaller than the outer diameter of the wheel. In some cases, the middle layer extends partially through the grinding zone. In other cases it only extends through the unused zone of the wheel. In further cases, the middle layer reinforces the arbor region of the wheel and only partially extends through the unused zone. In yet other cases, the only reinforcement provided in the grinding zone consists of two full diameter fiberglass webs, neither of which is at the neutral axis. Cut-off wheels also can have a full diameter fiberglass web, e.g., having one or more of the characteristics described herein, at the neutral zone.

Specific embodiments of the invention relate to one or more of the following factors characterizing the web: (i) the physical design of the web, e.g., hole opening, strand yield, filament diameter, and/or amount of coating, for instance, the coverage of the web with coating; (ii) chemistry of the coating to improve compatibility of the coating with the matrix resin; or (iii) the chemistry of the sizing used on the glassfiber stands, to improve compatibility of the glass with the coating. These embodiments are further described below.

While it has been discovered that wheel performance is not directly dependent on the tensile strength of the fiberglass, other properties of the fiber web employed have been found to affect this performance. In one aspect, for instance, the invention relates to the design of the fiber reinforcement, e.g., to reinforcement webs that have optimally sized web openings.

Figure 7:
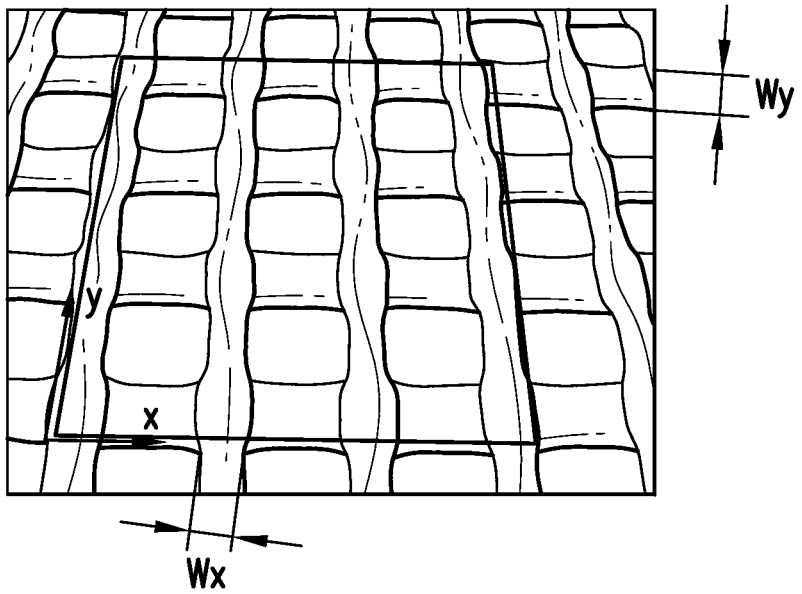
FIG. 7 is a view of web openings in a fiberglass web that can be employed in accordance with embodiments of the present invention.

For a woven arrangement such as shown in FIG. 7, fiberglass per unit area can be calculated as follows. Defining the width of a glass fiber in the x direction as Wx and the width of a fiber in the y direction as Wy, the fiber surface per unit area is the sum of: (i) Wx multiplied by the number of strands per unit area that are in the x direction; and (ii) Wy multiplied by the number of strands per unit area that are in the y direction. As shown below:

$$\text{Fiberglass surface per unit}=[Wx*(\#\text{strands in } x \text{ direction})+Wy*(\#\text{strands in } y \text{ direction})].$$

It has been discovered that a decrease in fiberglass density (or increasing the size of the web opening) results in improved performance. In preferred examples, the fiberglass reinforcement has a surface density that is no greater than 0.95.

Figures 8A, 8B:
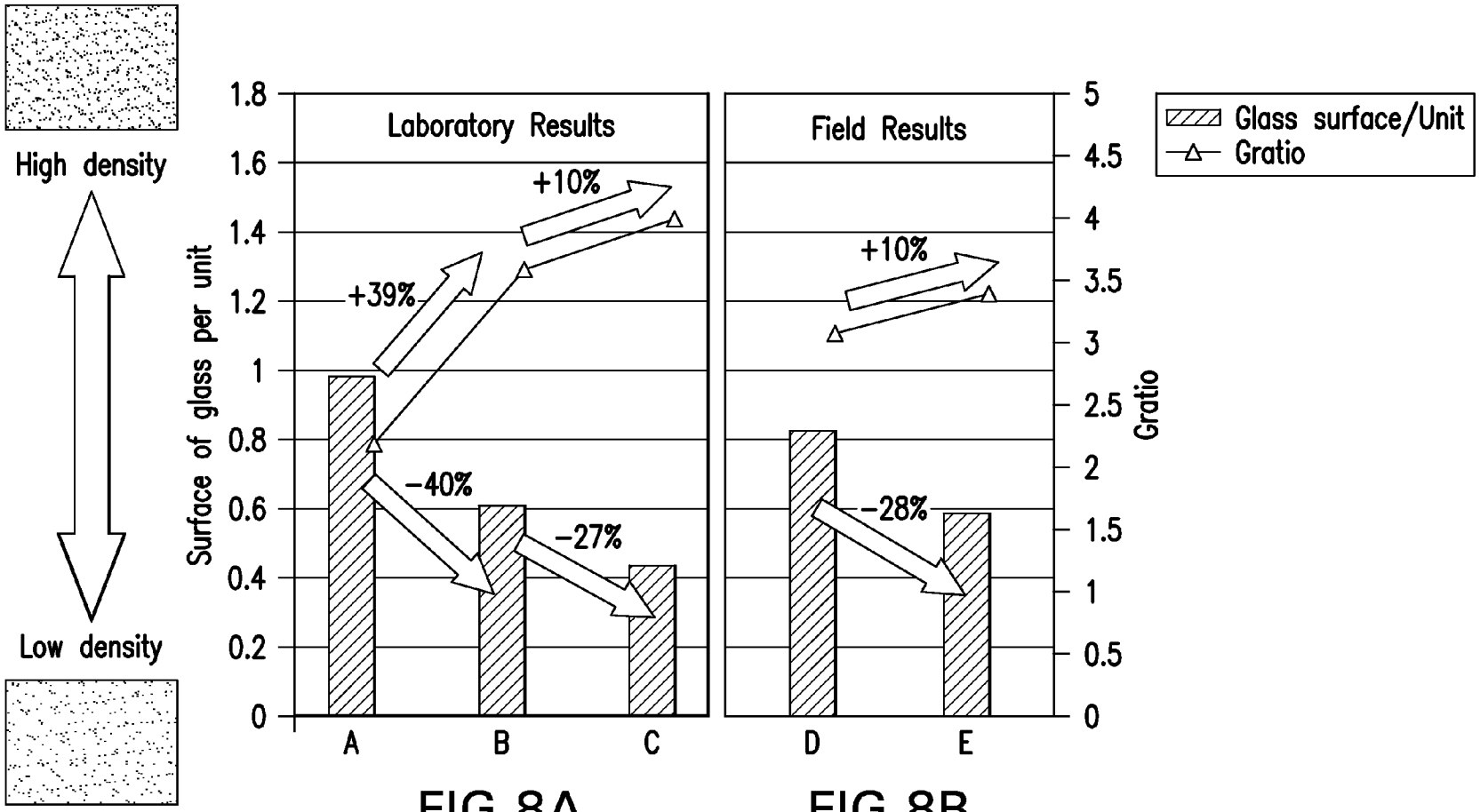
FIGS. 8A and 8B show the G ratio obtained with wheels that include fiberglass webs having different densities (or web openings) in laboratory and field tests, respectively.

Shown in FIGS. 8A and 8B, for example, are surface of glass per unit and corresponding G-ratio results for five web materials designated as A, B, C, D and E and obtained from Industrial Polymers and Chemicals (IPAC), of Shrewsburry, Mass. Grinding or G-ratio is an accepted measure of performance and is generally defined as the volume of material removed in a particular operation, divided by the volume of wheel that is worn away.

As illustrated in FIGS. 8A and 8B, both laboratory and field tests demonstrated an improvement in performance (increase in G-ratio) with decrease in surface of glass per unit. Thus cut-off wheels having larger openings in the glass web demonstrated improved performance and longer product life.

Exemplary wheels according to embodiments of the invention have one or more fiberglass reinforcement layers, at least one of them being web- or mesh-like and having a surface per unit area that is, e.g., within the range of from about 0.2 to about 0.95.

Alternatively or in addition to decreasing surface density as described above, the amount of fiberglass employed can be reduced by decreasing the thickness of the fiber. In one example, for instance, the fiberglass web preferably has a thickness no greater than about 2 mm. In specific implementations, the fiberglass web utilized in a cut-off wheel has a thickness within the range of from about 0.25 mm to about 1 mm, preferably from about 0.4 mm to about 0.9 mm.

The fiberglass reinforcement can have a glass volume ratio (which is the glass surface ratio multiplied by the thickness of the reinforcement) that is no greater than 0.2%, e.g., no greater than 0.95%.

Filament diameter also can affect physical properties of the web. In specific examples, reinforcements are made utilizing filament diameters within the range of from about 5 microns to about 30 microns.

Strand yield describes the bare glass yardage before the coating is applied. In specific examples, the strand yield is 300 to 2400 tex.

While the strength of the fiberglass reinforcement can affect the performance of the abrasive articles described herein, the invention also addresses chemistry aspects related to the fiberglass coatings, as further described below.

Generally, there are two types of chemical "coatings" that are present on a fiberglass web. A first coating, often referred to as "sizing", is applied to the glass fiber strands immediately after they exit the bushing and includes ingredients such as film formers, lubricants, silanes, typically dispersed in water. A second coating is applied to the glass web and traditionally includes wax, used primarily to prevent 'blocking' of the webs during shipping and storage.

The sizing typically provides protection of the filaments from processing-related degradation (such as abrasion). It can also provide abrasion protection during secondary processing such as weaving into a web. Some aspects of the invention relate to the strategic manipulation of properties associated with the first coating (sizing). In some implementations, fiberglass strands employed in the reinforcement web are treated with one or more compounds, e.g., sizing agents, and improved adhesion is obtained by considering the chemistry of the sizing agent. In specific implementations of the invention, the fiberglass is treated with a starch-free plastic sizing containing silane bonding agents that are compatible with resin systems such as epoxy, phenol or unsaturated polyester. A commercially available example is the size system developed by Saint-Gobain Vetrotex under the designation TD22. Other sizes also can be employed. Without wishing to be held to a particular interpretation, it is believed that the chemistry of the first coating (sizing) improves the compatibility between the glass and the second coating.

Preferably, the second coating is compatible with both the sizing (first coating) and the matrix resin for which the reinforcement is intended. Aspects of the invention relate to the strategic manipulation of the chemistry, e.g., composition, and/or other characteristics associated with this second coating, as further described below. Without wishing to be held to a particular interpretation, it is believed that the chemistry and/or other parameters associated with the second coating can improve the compatibility between the second coating and the organic resin present in the bond-abrasive grains mixture employed to make the wheel.

Typically, this mixture includes abrasive grains, a bonding material, e.g., a matrix resin, and optional ingredients, such as, for instance fillers, processing aids, lubricants, crosslinking agents, antistatic agents and so forth.

Suitable abrasive grains include, for example, alumina-based abrasive grains. As used herein, the term "alumina," "$Al_2O_3$" and "aluminum oxide" are used interchangeably. Many alumina-based abrasive grains are commercially available and special grains can be custom made. Specific examples of suitable alumina-based abrasive grains which can be employed in the present invention include white alundum grain, designated as "38A grain", from Saint-Gobain Ceramics & Plastics, Inc. or pink alundum, designated as "86A grain", from Treibacher Schleifmittel, AG. Other abrasive grains such as, for instance, seeded or unseeded sintered sol gel alumina, with or without chemical modification, such as rare earth oxides, MgO, and the like, alumina-zirconia, boron-alumina, silicon carbide, diamond, cubic boron nitride, aluminum-oxynitride, and others, as well as combinations of different types of abrasive grains also can be utilized. In one implementation, at least a portion of the grains employed are wear-resistant and anti-friable alumina-zirconia grains produced by fusing zirconia and alumina at high temperatures (e.g., 1950° C.). Examples of such grains are available from Saint-Gobain Corporation under the designation of ZF®. The wear-resistant and anti-friable alumina-zirconia grains can be combined, for example, with sintered bauxite (e.g., 76A) grains, ceramic coated fused alumina (e.g., U57A) grains, fused aluminum oxide grains special alloyed with C and MgO and having angular grain shape (e.g., obtained from Treibacher Schleifmittel, AG under the designation of KMGSK and other abrasive materials.

The size of abrasive grains often is expressed as a grit size, and charts showing a relation between a grit size and its corresponding average particle size, expressed in microns or inches, are known in the art as are correlations to the corresponding United States Standard Sieve (USS) mesh size. Grain size selection depends upon the application or process for which the abrasive tool is intended. Suitable grit sizes that can be employed in various embodiments of the present invention range, for example, from about 16 (corresponding to an average size of about 1660 micrometers (μm)) to about 320 (corresponding to an average size of about 32 μm).

In specific implementations of the present invention, the bond is an organic bond, also referred to as a "polymeric" or "resin" bond, typically obtained by curing a bonding material. An example of an organic bonding material that can be employed to fabricate bonded abrasive articles includes one or more phenolic resins. Such resins can be obtained by polymerizing phenols with aldehydes, in particular, formaldehyde, paraformaldehyde or furfural. In addition to phenols, cresols, xylenols and substituted phenols can be employed. Comparable formaldehyde-free resins also can be utilized.

Among phenolic resins, resoles generally are obtained by a one step reaction between aqueous formaldehyde and phenol in the presence of an alkaline catalyst. Novolac resins, also known as two-stage phenolic resins, generally are produced under acidic conditions and in the presence of a cross-linking agent, such as hexamethylenetetramine (often also referred to as "hexa").

The bonding material can contain more than one phenolic resin, e.g., at least one resole and at least novolac-type phenolic resin. In many cases, at least one phenol-based resin is in liquid form. Suitable combinations of phenolic resins are described, for example, in U.S. Pat. No. 4,918,116 to Gardziella, et al., the entire contents of which are incorporated herein by reference.

Examples of other suitable organic bonding materials include epoxy resins, polyester resins, polyurethanes, polyester, rubber, polyimide, polybenzimidazole, aromatic polyamide, and so forth, as well as mixtures thereof. In a specific implementation, the bond includes phenolic resin.

Abrasive grains can be combined with the bonding material to form a mixture using known blending techniques and equipment such as, for instance, Eirich mixers, e.g., Model RV02, Littleford, bowl-type mixers and others.

The mixture can also include fillers, curing agents and other compounds typically used in making organic-bonded abrasive articles. Any or all of these additional ingredients can be combined with the grains, the bonding material or with a mixture of grain and bonding material.

Fillers may be in the form of a finely divided powder, granules, spheres, fibers or some otherwise shaped materials. Examples of suitable fillers include sand, silicon carbide, bubble alumina, bauxite, chromites, magnesite, dolomites, bubble mullite, borides, fumed silica, titanium dioxide, carbon products (e.g., carbon black, coke or graphite), wood flour, clay, talc, hexagonal boron nitride, molybdenum disulfide, feldspar, nepheline syenite, various forms of glass such as glass fiber and hollow glass spheres and others. Mixtures of more than one filler are also possible. Other materials that can be added include processing aids, such as: antistatic agents, e.g., metal oxides, such as lime, zinc oxide, magnesium oxide, mixtures thereof and so forth; and lubricants, e.g., stearic acid and glycerol monostearate, graphite, carbon, molybdenum disulfite, wax beads, calcium fluororide and mixtures thereof. Note that fillers may be functional (e.g., grinding aids such as lubricant, porosity inducers, and/or secondary abrasive grain) or more inclined toward non-functional qualities such as aesthetics (e.g., coloring agent). In a specific implementation, the filler includes potassium fluoroborate and/or manganese compounds, e.g., chloride salts of manganese, for instance an eutectic salt made by fusing manganese dichloride ($MnCl_2$) and potassium chloride (KCl), available, from Washington Mills under the designation of MKCS.

In many instances the amount of filler is in the range of from about 0.1 and about 30 parts by weight, based on the weight of the entire composition. In the case of abrasive discs, the level of filler material can be in the range of about 5 to 20 parts by weight, based on the weight of the disc.

In specific embodiments the abrasive grains are fused alumina-zirconia abrasives, alundum abrasives, and the bond includes phenolic resins and fillers.

Curing or cross-linking agents that can be utilized depend on the bonding material selected. For curing phenol novolac resins, for instance, a typical curing agent is hexa. Other amines, e.g., ethylene diamine; ethylene triamine; methyl amines and precursors of curing agents, e.g., ammonium hydroxide which reacts with formaldehyde to form hexa, also can be employed. Suitable amounts of curing agent can be in the range, for example, of from about 5 to about 20 parts by weight of curing agent per hundred parts of total phenol novolac resin.

Effective amounts of the curing agent that can be employed usually are about 5 to about 20 parts (by weight) of curing agent per 100 parts of total novolac resin. Those of ordinary skill in the area of resin-bound abrasive articles will be able to adjust this level, based on various factors, e.g., the particular types of resins used; the degree of cure needed, and the desired final properties for the articles: strength, hardness, and grinding performance. In the preparation of abrasive wheels, a preferred level of curing agent is about 8 parts to about 15 parts by weight.

As described above, fiberglass web or mesh that is designed for reinforcing abrasive articles is prepared by treating, e.g., by coating, dipping or otherwise impregnating, the fiberglass web or mesh (that has fiberglass strands already coated with a sizing agent) with a second coating. Traditionally, the composition of this second coating includes wax, a common lubricant. This composition can also include polymeric materials, e.g., phenolic or epoxy-modified resins.

The treated fiberglass web can be baked or cured by any suitable means, as known in the art. In some aspects of the invention, the second coating on the fiberglass web is cured to achieve partial crosslinking of polymeric materials present in the coating, e.g., phenolic or epoxy-modified resins. Without wishing to be held to a particular interpretation of the invention, it is believed that a low degree of cure (or extent of polymerization) of the web coating can increase or maximize the adhesion to the matrix resin employed to form the bonded abrasive article, adhesion being a function of the number of reactive sites and the solubility of the coating to and with the matrix resin. In further aspects of the invention, the degree of cure is balanced for both adhesion and "handling", since in some cases, achieving a low degree of polymerization and a high number of reactive sites may lead to "blocking", a process in which the web fuses with other webs.

The fiberglass reinforcement can be shaped for the intended use, for instance after the drying step. For grinding wheel applications, for example, the web is cut to form reinforcements such as described above and hole-punched to accommodate a rotating spindle.

It was discovered that adhesion between a fiberglass reinforcement and an organic, e.g., phenolic resin, bond-containing mixture is improved when no wax is utilized in the treatment of the fiberglass. Thus in specific aspects of the invention, the second coating used to treat the fiberglass reinforcement employed to form bonded abrasive tools is a composition (containing, for example, phenolic or epoxy-modified resins) that excludes wax.

Without wishing to be held to a particular interpretation of the invention, it is believed that the absence of wax in the treatment of the fiberglass-reinforcement improves the quality of the interface between fiberglass web and mix, e.g., an organic bond-containing mixture such as discussed above, resulting in better adhesion between the reinforcement layer and the mix.

Some embodiments of the invention address the quality of the second coating, with preferred coatings being those that maximize coverage of the reinforcement, e.g., a fiberglass web or mesh, at interface surfaces, i.e., surfaces where the reinforcement material, e.g., fiberglass material, contacts the mixture. Improved coverage of the fiberglass can be obtained by techniques such as dipping, soaking, and others. In specific implementations, at least 99% of the interface surfaces are coated.

Figure 9:
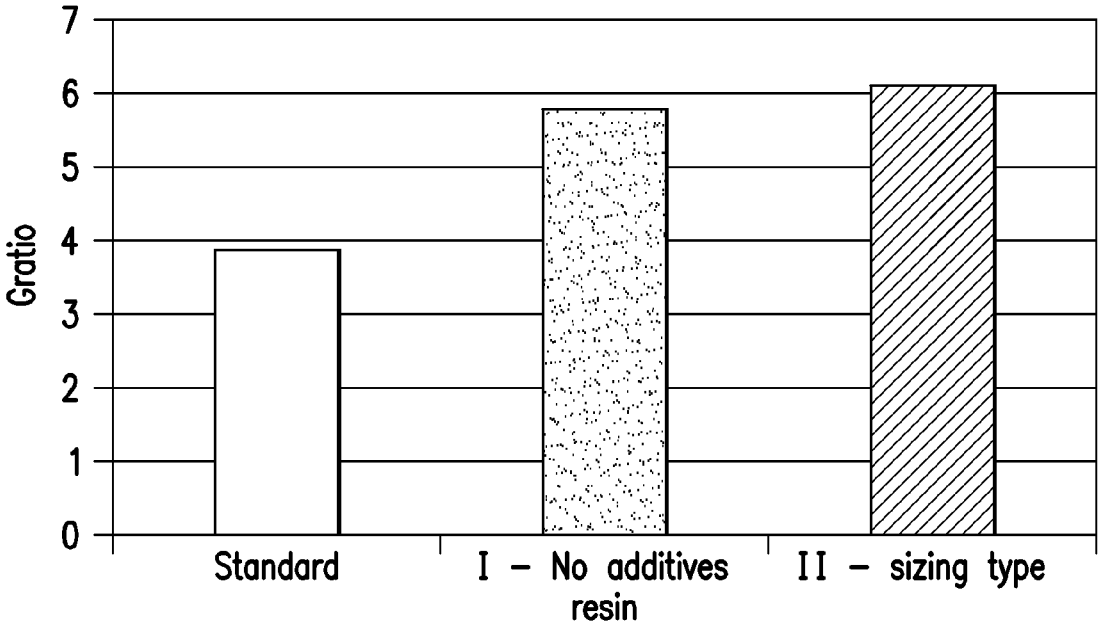
FIG. 9 illustrates a comparison between a standard wheel and wheels configured in accordance with various embodiments of the present invention, including factors such as absence of wax additive and coating with a sizing system

Shown in FIG. 9 is a comparison of the effects on G-ratio of several of the factors discussed above. A standard wheel reinforced with fiberglass was prepared using a conventional resin type (including wax lubricant) and a conventional sizing agent.

The standard wheel was compared with modified wheels I and II which were reinforced according to aspects of this invention. The modified wheels were fabricated using the same abrasive grains, bond and filler as the standard wheel, but differed from the standard wheel with respect to the reinforcement layer employed. Modified wheel I, for instance, included a reinforcement that was prepared without wax; modified wheel II was coated using a sizing agent, in this case the TD22 system described above.

Features and techniques utilized to improve the adhesion between fiberglass reinforcements and the mix can be practiced in conjunction with any reinforcement configuration or geometry suitable for making bonded abrasive tools and with any dimension of fiber web openings, fiber web, filament diameter or strand yield. In specific examples, the web reinforcement has one or more design characteristics described above, e.g., increased web opening dimensions and/or a reduced web thickness.

The bonded abrasive tools described herein can be produced by forming a green body that includes one or more reinforcement layers. As used herein, the term "green" refers to a body which maintains its shape during the next process step, but generally does not have enough strength to maintain its shape permanently; resin bond present in the green body is in an uncured or unpolymerized state. The green body preferably is molded in the shape of the desired article, e.g., wheel, disc, wheel segment, stone and hone, and so forth, with one or more reinforcement layers embedded therein.

One or more reinforcement layers, e.g., fiberglass webs such as described herein, can be incorporated in the green body by: placing and distributing at the bottom of an appropriate mold cavity a first portion of a mixture containing abrasive grains and bonding material; and then covering this portion with a first reinforcement layer. A preferred reinforcement layer is a fiberglass mesh or web such as described above. To improve adherence or bonding between the mixture and the reinforcement layer, the fiberglass reinforcement can be coated as described above, e.g., with a composition that excludes wax and/or can have a partially crosslinked coating. Coatings that cover at least 99% of the fiberglass interface surfaces are preferred. A second portion of the bond/abrasive mixture can then be disposed and distributed over the first reinforcement layer. Additional reinforcement and/or bond/abrasive mixture layers can be provided, if so desired. The amounts of mix added to form a particular layer thickness can be calculated as known in the art. Other suitable techniques can be employed to shape the green body.

Processes that can be used to make bonded abrasive wheels in accordance with embodiments of the present invention, include, for example, cold pressing, warm pressing or hot pressing.

Cold pressing, for instance, is described in U.S. Pat. No. 3,619,151, which is incorporated herein by reference. Cold pressing can be conducted by delivering to and evenly distributing within the cavity of a suitable mold a predetermined, weighed charge of the blended composition or mixture. The mixture is maintained at ambient temperature, e.g., less than about 30 degree C. (° C.). Pressure is applied to the uncured mass of material by suitable means, such as a hydraulic press. The pressure applied can be, e.g., in the range of about 70.3 $kg/cm^2$ (0.5 tsi) to about 2109.3 $kg/cm^2$ (15 tsi), and more typically in the range of about 140.6 $kg/cm^2$ (1 tsi) to about (6 tsi). The holding time within the press can be, for example, within the range of from about 5 seconds to about 1 minute.

Warm pressing is a technique very similar to cold pressing, except that the temperature of the mixture in the mold is elevated, usually to a temperature below about 140° C., and more often, below about 100° C. Suitable pressure and holding time parameters can be, for example, the same as in the case of cold pressing.

Hot pressing is described, for example, in a Bakelite publication, Rutaphen™—Resins for Grinding Wheels—Technical Information. (KN 50E-09.92-G&S-BA), and in Another Bakelite publication: Rutaphen Phenolic Resins—Guide/Product Ranges/Application (KN107/e-10.89 GS-BG). Useful information can also be found in Thermosetting Plastics, edited by J. F. Monk, Chapter 3 ("Compression Moulding of Thermosets"), 1981 George Goodwin Ltd. in association with The Plastics and Rubber Institute. For the purpose of this disclosure, the scope of the term "hot pressing" includes hot coining procedures, which are known in the art. In a typical hot coining procedure, pressure is applied to the mold assembly after it is taken out of the heating furnace.

To illustrate, an abrasive article can be prepared by disposing layers of a mixture including abrasive grains, bond material and, optionally, other ingredients, below and above one or more reinforcement layer(s) in an appropriate mold, usually made of stainless-, high carbon-, or high chrome-steel. Shaped plungers may be employed to cap off the mixture. Cold preliminary pressing is sometimes used, followed by preheating after the loaded mold assembly has been placed in an appropriate furnace. The mold assembly can be heated by any convenient method: electricity, steam, pressurized hot water, hot oil or gas flame. A resistance- or induction-type heater can be employed. An inert gas like nitrogen may be introduced to minimize oxidation during curing.

The specific temperature, pressure and time ranges can vary and will depend on the specific materials employed, the type of equipment in use, dimensions and other parameters. Pressures can be, for example, in the range of from about 70.3 $kg/cm^2$ (0.5 tsi) to about 703.2 $kg/cm^2$ (5.0 tsi,) and more typically, from about 70.3 $kg/cm^2$ (0.5 tsi) to about 281.2 $kg/cm^2$ (2.0 tsi). The pressing temperature for this process is typically in the range of about 115° C. to about 200° C.; and more typically, from about 140° C. to about 170° C. The holding time within the mold is usually about 30 to about 60 seconds per millimeter of abrasive article thickness.

A bonded abrasive article is formed by curing the organic bonding material. As used herein, the term "final cure temperature" is the temperature at which the molded article is held to effect polymerization, e.g., cross-linking, of the organic bond material, thereby forming the abrasive article. As used herein, "cross-linking" refers to the chemical reaction(s) that take(s) place in the presence of heat and often in the presence of a cross-linking agent, e.g., hexa, whereby the organic bond composition hardens. Generally, the molded article is soaked at a final cure temperature for a period of time, e.g., between 10 and 36 hours, or until the center of mass of the molded article reaches the cross-linking temperature and hardens.

Selection of a curing temperature depends, for instance, on factors such as the type of bonding material employed, strength, hardness, and grinding performance desired. In many cases the curing temperature can be in the range of from about 150° C. to about 250° C. In more specific embodiments employing organic bonds, the curing temperature can be in the range of about 150° C. to about 200° C. Suitable curing time intervals can range, for example, from about 6 hours to about 48 hours.

Polymerization of phenol based resins, for example, generally takes place at a temperature in the range of between about 110° C. and about 225° C. Resole resins generally polymerize at a temperature in a range of between about 140° C. and about 225° C. and novolac resins generally at a temperature in a range of between about 110° C. and about 195° C. The final cure temperature also can depend on other factors such as, for example, the size and/or shape of the article, the duration of the cure, the exact catalyst system employed, wheel grade, resin molecular weight and chemistry, curing atmosphere and other criteria. For many suitable phenol-based materials, the final cure temperature is at least about 150° C.

The process of heating a green body to the final cure temperature and holding it at that temperature to effect hardening of the bonding material often is referred to as the "cure" or "bake" cycle. Preferably large green bodies are heated slowly in order to cure the product evenly, by allowing for the heat transfer process to take place. "Soak" stages may be used at given temperatures to allow the wheel mass to equilibrate in temperature during the heating ramp-up period prior to reaching the temperature at which the bond material is polymerized. A "soak" stage refers to holding the molded mixture, e.g., green body, at a given temperature for a period of time. A slow heating approach also allows a slow (controlled) release of volatiles generated from by-products during the baking cycle.

To illustrate, a green body for producing a reinforced bonded abrasive article may be pre-heated to an initial temperature, e.g., about 100° C., where it is soaked, for instance, for a time period, from about 0.5 hours to several hours. Then the green body is heated, over a period of time, e.g. several hours, to a final cure temperature where it is held or soaked for a time interval suitable to effect the cure. If, initially, the second coating applied to the web reinforcement present in the green body is only partially cured (corsslinked), the bake cycle to which the green body is subjected to form the reinforced bonded abrasive article can complete the polymerization of materials present in the second coating, thereby improving adhesion between the reinforcement and the matrix resin.

Once the bake cycle is completed, the abrasive article can be stripped from the mold and air-cooled. If desired, subsequent steps such as edging, finishing, truing, balancing and so forth, can be conducted according to standard practices.

The reinforced bonded abrasive articles described herein can be fabricated to have a desired porosity. The porosity can be set to provide a desired wheel performance, including parameters such as wheel hardness and strength, as well as chip clearance and swarf removal.

Porosity can include closed type porosity, where void pores or cells generally do not communicate with one another, or open, also referred to as "interconnected" porosity. Both types can be present. Examples of techniques that can be used for inducing closed and interconnected porosities are described in U.S. Pat. Nos. 5,203,886, 5,221,294, 5,429,648, 5,738,696 and 5,738,697, 6,685,755 and 6,755,729, each of which is herein incorporated by reference in its entirety. Finished bonded abrasive articles described herein may contain porosity within the range of from about 0% to about 80%. In one implementation, the porosity is within the range of from about 0% to about 30%.

A bonded abrasive article configured in accordance with embodiments of the present invention can be monolithic or segmental in nature. As will be apparent in light of this disclosure, the reinforcement component is essentially the same for either case, with the size and shape of the reinforcement being adjusted to fit within the monolithic or segmental design.

The following example illustrates specific aspects of the invention and is not intended as limiting.

EXAMPLE

Experimental and comparative cut-off wheels were prepared to contain the same abrasive grains and organic bond. Both types were configured to include several internal E-glass reinforcements, as shown in Table 1 below, which also shows the wheel diameters of the experimental and comparative wheels tested. In all cases, the internal reinforcements had the same diameter as the wheel.

TABLE 1

| Run # | No. of Internal Reinforcements | Wheel Diameter (mm) |
|---|---|---|
| A | 3 | 1510 |
| B | 5 | 1510 |
| C | 3 | 1515 |

TABLE 1-continued

| Run # | No. of Internal Reinforcements | Wheel Diameter (mm) |
|---|---|---|
| D | 4 | 1560 |
| E | 3 | 1550 |

In the case of experimental wheels, the glass volume ratio was 74%. The thickness of the reinforcement layer was 0.64 mm and the size of the openings was 4.2 mm by 3 mm. No wax or additives were used on the fiberglass web bond. The size employed was Saint-Gobain Vetrotex TD22.

Comparative wheels had a glass volume ratio of 82%. The reinforcement layer had a thickness of 0.76 mm and a size of openings of 3.1 mm by 4 mm. Wax and additives were used but no sizing was employed.

The wheels were tested in hot or cold cutting of stainless steel, stainless steel special grade, titanium, nickel or carbon steel workpieces. In some runs the workpiece was special grade stainless steel with a bar size of 190 mm. The wheel feed rate was 2.5 to 3 square inches per second and wheel speed was 16500 feet per minute.

In other runs, the workpiece was a carbon steel bar of 150 to 230 mm. The wheel feed rate was about 1.6 square inches per second and the wheel speed was 80 meters per second.

The G-ratio observed with the experimental wheels was at least about 15% greater than the G-ratio observed with the comparative wheels. In some cases, the improvement was at least 20%. In others it was at least 30%. For instance, cold cutting tested on 40 workpieces with a wheel having 3 internal reinforcements (run #A) showed more than a 20% improvement with respect to the corresponding comparative wheel. Hot cutting with the experimental wheel having 3 internal reinforcements (run #C) showed more than a 15% improvement in G-ration with respect to the comparative wheel. Hot cutting with the experimental wheel having 5 internal reinforcements (run #B) showed more than a 30% improvement in G-ration with respect to the comparative wheel. Experimental wheels having 4 internal reinforcements (run #D) showed a 15% improvement in G-ratio over comparative wheels. Good results also were observed with the experimental wheel in run #E.

In many cases, the experimental wheels also outperformed existing commercial wheels typically used in the respective cutting operation.

While this invention has been particularly shown and described with references to preferred embodiments thereof, it will be understood by those skilled in the art that various changes in form and details may be made therein without departing from the scope of the invention encompassed by the appended claims.

The Abstract of the Disclosure is provided solely to comply with U.S. requirements and, as such, is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all features of any of the disclosed embodiments. Thus, the following claims are incorporated into the Detailed Description, with each claim standing on its own as defining separately claimed subject matter.

What is claimed is:

1. A bonded abrasive wheel comprising:

a disc shaped body, the disc shaped body comprising:

a neutral axis lying along a central plane of the disc shaped body;

an arbor hole extending through the body;

a generally flat first face extending from the arbor hole to a wheel outer diameter;

a generally flat second face extending from the arbor hole to the wheel outer diameter opposite the first face;

a non-grinding zone adjacent to the arbor hole between the first face and the second face;

a grinding zone extending from the non-grinding zone to a wheel outer diameter along the first face and the second face;

a first reinforcement layer between the neutral axis and the first face;

a second reinforcement layer between the neutral axis and the second face opposite the first reinforcement layer, wherein one or more of said reinforcements are fiberglass webs, and wherein the fiberglass web is coated with a sizing system and a second coating that excludes wax.

2. A bonded abrasive wheel comprising:

a disc shaped body, the disc shaped body comprising:

a neutral axis lying along a central plane of the disc shaped body;

an arbor hole extending through the body;

a generally flat first face extending from the arbor hole to a wheel outer diameter;

a generally flat second face extending from the arbor hole to the wheel outer diameter opposite the first face;

a non-grinding zone adjacent to the arbor hole between the first face and the second face;

a grinding zone extending from the non-grinding zone to a wheel outer diameter along the first face and the second face;

a first reinforcement layer between the neutral axis and the first face;

a second reinforcement layer between the neutral axis and the second face opposite the first reinforcement layer, wherein one or more of said reinforcements are fiberglass webs, and wherein the fiberglass web is produced by partially curing a second coating applied to the fiberglass web.

3. A bonded abrasive wheel comprising:

a disc shaped body, the disc shaped body comprising:

a neutral axis lying along a central plane of the disc shaped body;

an arbor hole extending through the body;

a generally flat first face extending from the arbor hole to a wheel outer diameter;

a generally flat second face extending from the arbor hole to the wheel outer diameter opposite the first face:

a non-grinding zone adjacent to the arbor hole between the first face and the second face;

a grinding zone extending from the non-grinding zone to a wheel outer diameter along the first face and the second face;

a first reinforcement layer between the neutral axis and the first face;

a second reinforcement layer between the neutral axis and the second face opposite the first reinforcement layer, wherein one or more of said reinforcements are fiberglass webs, and wherein at least 99% of the fiber interface surfaces are coated with the second coating.

4. A bonded abrasive tool comprising one or more fiberglass webs, wherein at least one fiberglass web has a fiberglass surface per unit area that is no greater than about 0.95, and wherein the at least one fiberglass web has a second coating that excludes wax or a second coating produced by a process in which polymeric materials present in the second coating are partially crosslinked.

5. The bonded abrasive tool of claim 4, wherein the at least one fiberglass web has a fiberglass surface per unit area within the range of from about 0.2 and about 0.95.

6. A method for producing a bonded abrasive article, the method comprising:

a. combining abrasive grains and a bonding material to prepare a mixture;

b. molding the mixture into a green body that includes at least one fiberglass reinforcement; and c. curing the bonding material to produce the bonded abrasive article, wherein (i) the fiberglass reinforcement is coated with a second coating that does not include wax, is partially cross-linked or both; or (ii) the fiberglass reinforcement has a fiberglass surface density that is no greater than 0.95, wherein at least 99 percent of fiberglass interface surfaces are coated with the second coating.

7. The method of claim 6, wherein the fiberglass reinforcement has a surface density within a range of from about 0.2 to about 0.95.

8. The bonded abrasive wheel of claim 1, further comprising a third reinforcement layer lying along the neutral axis, wherein the third reinforcement does layer not extend through the grinding zone.

9. The bonded abrasive wheel of claim 1, further comprising a third reinforcement layer lying along the neutral axis, wherein the third reinforcement layer at least partially extends through the grinding zone.

10. The bonded abrasive wheel of claim 1, further comprising a third reinforcement layer lying along the neutral axis, wherein the third reinforcement layer has a diameter that is at least 80 percent of the wheel outer diameter.

11. The bonded abrasive wheel of claim 1, wherein the wheel has a diameter to thickness ratio within the range of from about 200:3 and about 100:1.

12. The bonded abrasive wheel of claim 1, wherein the wheel has a thickness within the range of from about 12 mm to about 16 mm and the first and second reinforcements are apart from each other by a distance within the range of from about 2 mm to about 10 mm.

13. The bonded abrasive wheel of claim 1, wherein the wheel has a bending strength of about 75 MPa.

14. The bonded abrasive wheel of claim 1, comprising abrasive grains selected from the group consisting of fused alumina-zirconia abrasives and alundum abrasives, a bond including phenolic resins and a filler.

15. The bonded abrasive wheel of claim 1, wherein the fiberglass web has a fiberglass surface per unit area that is within the range of from about 0.2 to about 0.95.

16. The bonded abrasive wheel of claim 2, further comprising a third reinforcement layer lying along the neutral axis, wherein the third reinforcement does layer not extend through the grinding zone.

17. The bonded abrasive wheel of claim 2, further comprising a third reinforcement layer lying along the neutral axis, wherein the third reinforcement layer at least partially extends through the grinding zone.

18. The bonded abrasive wheel of claim 2, further comprising a third reinforcement layer lying along the neutral axis, wherein the third reinforcement layer has a diameter that is at least 80 percent of the wheel outer diameter.

19. The bonded abrasive wheel of claim 2, wherein the wheel has a diameter to thickness ratio within the range of from about 200:3 and about 100:1.

20. The bonded abrasive wheel of claim 2, wherein the wheel has a thickness within the range of from about 12 mm to about 16 mm and the first and second reinforcements are apart from each other by a distance within the range of from about 2 mm to about 10 mm.

21. The bonded abrasive wheel of claim 2, wherein the wheel has a bending strength of about 75 MPa.

22. The bonded abrasive wheel of claim 2, comprising abrasive grains selected from the group consisting of fused alumina-zirconia abrasives and alundum abrasives, a bond including phenolic resins and a filler.

23. The bonded abrasive wheel of claim 2, wherein the fiberglass web has a fiberglass surface per unit area that is within the range of from about 0.2 to about 0.95.

24. The bonded abrasive wheel of claim 3, further comprising a third reinforcement layer lying along the neutral axis, wherein the third reinforcement does layer not extend through the grinding zone.

25. The bonded abrasive wheel of claim 3, further comprising a third reinforcement layer lying along the neutral axis, wherein the third reinforcement layer at least partially extends through the grinding zone.

26. The bonded abrasive wheel of claim 3, further comprising a third reinforcement layer lying along the neutral axis, wherein the third reinforcement layer has a diameter that is at least 80 percent of the wheel outer diameter.

27. The bonded abrasive wheel of claim 3, wherein the wheel has a diameter to thickness ratio within the range of from about 200:3 and about 100:1.

28. The bonded abrasive wheel of claim 3, wherein the wheel has a thickness within the range of from about 12 mm to about 16 mm and the first and second reinforcements are apart from each other by a distance within the range of from about 2 mm to about 10 mm.

29. The bonded abrasive wheel of claim 3, wherein the wheel has a bending strength of about 75 MPa.

30. The bonded abrasive wheel of claim 3, comprising abrasive grains selected from the group consisting of fused alumina-zirconia abrasives and alundum abrasives, a bond including phenolic resins and a filler.

31. The bonded abrasive wheel of claim 3, wherein the fiberglass web has a fiberglass surface per unit area that is within the range of from about 0.2 to about 0.95.

* * * * *